US005716466A

United States Patent [19]

Yamaoka et al.

[11] Patent Number: 5,716,466

[45] Date of Patent: *Feb. 10, 1998

[54] STAINLESS STEEL WIRE PRODUCT

[75] Inventors: Yukio Yamaoka, Sakai; Suchun Fang; Kishio Tamai, both of Amagasaki, all of Japan

[73] Assignee: Shinko Kosen Kogyo Kabushiki Kaisha, Amagasaki, Japan

[ * ] Notice: The term of this patent shall not extend beyond the expiration date of Pat. No. 5,545,482.

[21] Appl. No.: 672,239

[22] Filed: Jun. 28, 1996

Related U.S. Application Data

[63] Continuation of Ser. No. 248,157, May 24, 1994, abandoned.

[30] Foreign Application Priority Data

Dec. 20, 1993 [JP] Japan ..... 5-320257

[51] Int. Cl.[6] ..... C22C 38/00; C22C 38/44; E04C 5/08

[52] U.S. Cl. ..... 148/325; 148/326; 148/327; 148/597; 420/52; 420/57

[58] Field of Search ..... 148/325, 326, 148/327, 597, 608; 420/52, 57

[56] References Cited

U.S. PATENT DOCUMENTS

| | | | |
|---|---|---|---|
| 4,032,367 | 6/1977 | Richardson et al. | 420/57 |
| 5,238,508 | 8/1993 | Yoshitake et al. | 148/327 |

FOREIGN PATENT DOCUMENTS

| | | | |
|---|---|---|---|
| 59-70719 | 4/1984 | Japan | 148/608 |
| 61-157626 | 7/1986 | Japan | 148/326 |
| 4-198456 | 7/1992 | Japan | 148/327 |
| 1041267 | 9/1966 | United Kingdom | 148/597 |

*Primary Examiner*—Sikyin Ip

*Attorney, Agent, or Firm*—Oblon, Spivak, McClelland, Maier & Neustadt, P.C.

[57] ABSTRACT

Disclosed is a stainless steel wire made of a two-phase stainless steel having austenite and ferrite, which is used as a PC tension member and wire rope both for dynamic and static use. The stainless steel wire contains 0.01–0.10 wt % of C, 0.1–1.0 wt % of Si, 0.30–1.50% of Mn, 0.010–0.040 wt % of P, 0.001–0.030 wt % of S, 18.0–30.0 wt % of Cr, 3.0–8.0 wt % of Ni, 0.1–3.0 wt % of Mo, and 0.10–0.45 wt % of N, the balance being essentially Fe and inevitable impurities, wherein the volume ratio of the ferrite to the sum of the austenite and the ferrite is specified to be in the range from 20.0 to 80.0%. Upon drawing, the drawing draft is in the range from 40 to 97%, the mean slenderness ratio ($M_R$ value) is in the range from 4 to 20, and the aging temperature is in the range from 150° to 750° C. This stainless steel wire product provides a tension member suitable for tension members, hanging members and cables, that is high in tensile strength, elongation, fatigue strength, reduction of area, and torsion value, and low in relaxation value, and high in corrosion resistance. Moreover, provided is a stainless steel wire rope having corrosion resistance higher than wire ropes made of SUS304 and SUS316 and a fatigue strength higher than high carbon steel wire ropes, which is applicable for either dynamic or static use.

18 Claims, 6 Drawing Sheets

STAINLESS STEEL WIRE PRODUCT

This application is a continuation of application Ser. No. 08/248,157, filed on May 24, 1994, now abandoned.

BACKGROUND OF THE INVENTION

As tension members for prestressed concrete (PC), piano wires specified in JIS (Japanese Industrial Standard) G 3586 have been mainly used. The piano wire is made of a high carbon steel containing 0.62–0.92 wt % of C, which is excellent in the properties necessary for a tension member or a hanging member, such as tensile strength, elongation, relaxation value, fatigue strength, reduction of area and torsion value; however, it is extremely poor in corrosion resistance (rust resistance). For this reason, steel wires for prestressed concrete (hereinafter called "PC steel wires"), steel wire strands for prestressed concrete (hereinafter called "PC steel wire strands"), various cables and hanging members made of the above high carbon steel have been subjected to various corrosion-proof treatments, for example, plating, plastic coating and grout-filling sheath covering. These treatments have increased the cost of the PC steel wires and the like.

On the other hand, stainless steel wire ropes typically using SUS304 and SUS316 are mainly used at present in the field of wire ropes. The stainless steel wire rope is low in a fatigue strength, and tends to be broken in a short period, resulting in the reduced service life when being applied with a cyclic bending or the like. As a result, the stainless steel wire ropes, notwithstanding the high corrosion resistance, have been limited in the applications, that is, not for dynamic use but for static use as hanging articles.

In recent years, prestressed concrete gets wet in acid rain because of the change of environments for the worse, and in coast areas, it is covered with splash of salt water, resulting in the generation of cracks. Concrete has been thus neutralized, and tension members in concrete tend to be directly exposed to the environments, which has the fear that the safety of the concrete structure is degraded.

FIELD OF THE INVENTION

The present invention relates to a two-phase stainless steel wire product, and particularly to a new stainless steel wire product suitable for PC tension members, cables for suspension bridges, and hanger ropes for cable-stayed bridges.

DESCRIPTION OF THE RELATED ART

To cope with the above-described disadvantages, a corrosion preventive PC steel wire and a PC steel wire strand using SUS304 and SUS316 in JIS G 4308 have been developed (for example, "Iron and Steel", Vol. 72, No. 1, p78–84, 1986). These stainless steel wires are superior in corrosion resistance to high carbon steel wires; however, they have disadvantages as follows: namely, when the strength is increased up to 160 kgf/mm$^2$ or more, the elongation becomes low, the torsion value is low (about 5 turns), and the fatigue strength is only about one half that of high carbon steels, and further, the corrosion resistance is insufficient when they are used as tension members without any corrosion preventive treatment. Therefore, the above stainless steel wires cannot be used as the high corrosion resisting tension members in place of the tension members, the hanging members and the cables made of carbon steel. On the other hand, high carbon steel wire ropes are higher in fatigue strength and longer in service life for repeated bending than the above-described stainless steel wire ropes. For this reason, they have been used not only as the wire rope for static use but also as the wire rope for dynamic use. In particular, the high carbon steel wire rope is legally allowed to be exclusively used even for important security members such as the rope for an elevator that affects people's lives. The high carbon steel wire ropes, however, have a disadvantage in that the corrosion resistance is worse compared with the stainless steel wire ropes. Accordingly, if corrosion prevention is insufficient, they tend to generate pits even in the atmosphere, thereby often degrading even its excellent property of fatigue strength. Namely, the high carbon steel wire ropes have the problem to take a great care for the maintenance.

SUMMARY OF THE INVENTION

Accordingly, an object of the present invention is to provide a tension member capable of satisfying characteristics required for tension members, hanging members and cables, that is, being high in a tensile strength, elongation, fatigue strength, reduction of area, and torsion value, and being low in a relaxation value; and further, being high in a corrosion resistance (especially, rust resistance), thereby doubling the long-term quality assurance performance.

A further object of the present invention is to provide a stainless steel wire rope having a corrosion resistance higher than that of a wire ropes made of SUS304 and SUS316 and a fatigue strength higher than those of high carbon steel wire ropes, which is applicable as either a wire rope for static use or a wire rope for dynamic use with high reliability.

An additional object of the present invention is to provide the above-described stainless steel wire rope, which is made of a two-phase stainless steel containing nitrogen in a large amount.

To achieve the above objects, according to the present invention, there is provided a two-phase stainless steel wire product with specified properties, which is manufactured by a method of preparing a stainless steel having a specified composition (Fe, C, Si, Mn, P, S, Cr, Ni, Mo, N) wherein the volume ratio between ferrite and austenite is specified, and drawing the stainless steel thus obtained.

Moreover, in the present invention, there are provided two-phase stainless steel wire products capable of achieving respective characteristics suitable for a tension member and a wire rope, which are manufactured by a method of drawing stainless steels under the specified conditions such as the drawing draft (%), mean slenderness ratio and aging temperature.

The stainless steel wire products thus drawn into a specified diameter are stranded. This stainless steel strand is extremely excellent in a tensile strength and fatigue strength. The present inventors have found the fact that the above-described excellent properties are closely associated with the phase balance represented by the volume ratio between ferrite and austenite in the two-phase stainless steel, and with the slenderness ratio indicating the degrees of drawing of respective phases. On the basis of this new knowledge, the present invention has been accomplished.

FIG. 1 is an enlarged illustration showing the structure of a two-phase stainless steel wire. In the two-phase structure in which an austenite phase and a ferrite phase are mixed as shown in FIG. 1, the slenderness ratio $\gamma_R$ of austenite is expressed as $\gamma_R=\gamma_L/\gamma_W$; and the slenderness ratio a $\alpha_R$ of ferrite is expressed as $\alpha_R=\alpha_L/\alpha_W$. In the two-phase structure, two phases are mixed, so that the property of the whole material is obtained as the average of the properties of the two phases. Accordingly, the mean slenderness ratio $M_R$ is expressed as:

$$M_R = V_r \cdot \gamma_R + V_a \cdot \alpha_R$$

where $V_r$ is the volume ratio of austenite, and $V_a$ is the volume ratio of ferrite.

FIG. 2 shows the relationship between the drawing draft (%) and the mean slenderness ratio $M_R$ in a two-phase stainless steel wire. As shown in the figure, the mean slenderness ratio $M_R$ is 1 before drawing because each phase is of equi-axed grain structure. However, since each phase is extended by drawing in the direction of the drawing, the mean slenderness ratio $M_R$ is increased substantially linearly along with the advance of the drawing as shown in FIG. 2. On the basis of the results of various experiments, the present inventors have found the fact that the fatigue strength of the PC steel wire strand is apparently related to the mean slenderness ratio $M_R$ and the volume ratio of ferrite as shown in FIG. 3.

In FIG. 3, the PC wire strand of high carbon steel is compared with the PC wire strand of SUS304 in the tensile fatigue characteristic (fatigue strength obtained when the maximum load is specified at the value of 0.45 time of tensile strength). As is apparent from the figure, the structure having $M_R$ ranging from 4 to 20 and α ranging from 20 to 80% is excellent in the fatigue characteristic. This relationship has never been known for the PC steel strands. This is the same for the rotational bending fatigue characteristic of the PC steel wire (single wire). Moreover, from FIG. 2, the value of ME ranging from 4 to 20 (in this range, the fatigue life is long) corresponds to the drawing draft ranging from 40 to 97%. However, the stainless steel tension member, which has a large diameter, is not efficiently drawn with the draft of or more because of the increase in the cost. Namely, the upper limit of the drawing draft must be limited to 93%, and therefore, the upper limit of MR is specified at the value corresponding to the drawing draft of 93%, that is, 18.

FIG. 4 shows the change of the relaxation value depending on the aging temperature in two-phase stainless steel wires containing various amounts of N (wt %) and having 50% in volume of α. In the two-phase stainless steel wire, its strength is not affected by the drawing so much because of the presence of the soft ferrite phase (α phase); accordingly, the relaxation value is large when the N content is small. However, in the case of the two-phase stainless steel containing N of 0.1 wt % or more which is subjected to aging treatment at a temperature ranging from 200° to 700° C. the relaxation value satisfies the specification (3% or less) for the PC steel wire and the PC steel wire strand in JIS G 3536. Accordingly, as the tension member, the N content is required to be in the range of 0.1 wt % or more and the aging temperature is required to be in the range of 200° to 700° C. In addition, the upper limit of the N content is specified at 0.45 wt % from the reason described later.

FIG. 5 shows the relationship between the mean slenderness ratio $M_R$ and the cyclic bending fatigue limit of the wire rope with respect to the volume ratio of ferrite (α). As is apparent from the figure, the cyclic bending fatigue limit is excellent in the area where $M_R$ ranges are between 4 and 20 and the volume ratio of ferrite (α) ranges are between 20 and 80%. It becomes apparent from FIG. 5 that the aging treatment improves the fatigue characteristic. Accordingly, the effect of the aging temperature is further examined, which gives the result shown in FIG. 6. From this figure, the fatigue strength of the wire rope is high as stranded; however, it becomes higher by the aging treatment at a temperature ranging from 150° to 750° C., preferably, from 200° to 700° C.

FIG. 7 shows the creep strain after 200 hr for the wire rope (construction: 7×19, diameter: 8 mm) having the volume ratio of ferrite at 50%. The initial load being 30% of the tensile strength is applied at room temperature. In the wire rope, the creep strain is related to the permanent elongation of the rope in use, and is desirable to be smaller. While the creep strain includes the elongation due to the fastening of the rope structure, it is significantly reduced when the N content is 0.1 wt % or more. However, when the N content exceeds 0.45 wt %, bubbles are generated in steel making which leads to the serious defects. For this reason, the N content is specified to be in the range of 0.45 wt % or less.

On the basis of the above results, the reason for limiting the chemical component of the stainless steel wire product of the present invention will be described below.

C: 0. 01 to 0.1 wt %

When being excessively added, C tends to be precipitated at grain boundaries, thereby lowering the corrosion resistance; accordingly, the C content must be limited to be 0.1 wt % or less. When the C content is excessively low, the melting cost rises. Therefore, the lower limit of the C content is specified at 0.01 wt %.

Si: 0.1 to 1.0 wt %

Si is an element necessary for deoxidation of steel, and is required to be added in an amount of 0.1 wt % or more. However, when being added excessively, Si causes the embrittlement of steel, and therefore, it is limited to be 1 wt % or less.

Mn: 0.3 to 1.5 wt %

Mn is an element necessary for desulfurization of steel and must be added in an amount of 0.3 wt % or more. However, when excessively added, Mn causes the excessive hardening of the steel, leading to the harmed workability, and therefore, it is specified to be 1.5 wt % or less.

P: 0.010 to 0.040 wt %

When being excessively added, P causes the embrittlement of steel, and accordingly, it is limited in an amount of 0.040 wt % or less. The P content should be lowered as much as possible for softening steel. However, the lowering of the P content below 0.010 wt % greatly increases the cost, and therefore, the lower limit is specified at 0.010 wt %.

S: 0.001 to 0.030 wt %

When being excessively added, S causes non-metallic inclusions, thereby lowering the corrosion resistance of steel. For this reason, S is added in an amount of 0.03 wt % or less. However, when the S content is reduced below 0.001 wt % the melting cost rises, and therefore, the lower limit of the S content is specified at 0.001 wt %.

Cr: 15 to 30 wt %

When the Cr content is below 15 wt %, the corrosion resistance becomes poor. On the other hand, when being over 30 wt %, it deteriorates the workability in hot-rolling and increases the cost. Moreover, when Cr is excessively added, Ni must be added in a large amount for keeping the phase balance in a two-phase structure. Therefore, the Cr content is specified to be in the range from 15 to 30 wt %.

Ni: 3.0 to 8.0 wt %

Ni must be added in an amount from 3.0 to 8.0 wt % according to the above-described Cr content for obtaining the two-phase structure.

Mo: 0.1 to 3.0 wt %

Mo is added in an amount of 0.1 wt % or more to improve the corrosion resistance. The effect is increased linearly with the amount of Mo. However, since Mo is an expensive element, it is limited to be 3.0 wt % or less.

N: 0.1 to 0.45 wt %

As described above, to lower the relaxation value, N must be added in an amount of 0.1 wt % or more. However, when the N content exceeds 0.45 wt %, it causes bubbles in casting ingots, leading to the critical defects. Therefore, the upper limit of the N content is specified at 0.45 wt %.

On the basis of the new knowledge described above, according to the present invention, there is provided a stainless steel wire product suitable for a tension member, which is manufactured by drawing a two-phase stainless steel containing 0.01–0.10 wt % of C, 0.1–1.0 wt % of Si, 0.30–1.50% of Mn, 0.010–0.040 wt % of P, 0.001–0.030 wt % of S, 18.0–30.0 wt % of Cr, 3.0–8.0 wt % of Ni, 0.1–3.0 wt % of Mo, and 0.10–0.45 wt % of N, the balance being essentially Fe and inevitable impurities, wherein the volume ratio of the ferrite amount to the sum of the austenite amount and the ferrite amount is specified to be in the range from 20.0 to 80.0%, wherein upon drawing, the drawing draft is in the range from 40 to 93%, the mean slenderness ratio ($M_R$ value) is in the range from 4 to 18, and the aging temperature is in the range from 200° to 700° C.

Moreover, according to the present invention, there is provided a stainless steel wire product suitable for a wire rope, which is manufactured by drawing a two-phase stainless steel wire containing 0.01–0.10 wt % of C, 0.1–1.0 wt % of 8%, 0.80–1.50% of Mn, 0.010–0.040 wt % of P, 0.001–0.080 wt % of S, 18.0–30.0 wt % of Cr, 8.0–8.0 wt % of Ni, 0.1–8.0 wt % of Mo, and 0.10–0.45 wt % of N, the balance being essentially Fe and inevitable impurities, wherein the volume ratio of the ferrite amount to the sum of the austenite amount and the ferrite amount is specified to be in the range from 20.0 to 80.0%, wherein upon drawing, the drawing draft is in the range from 40 to 97%, the mean slenderness ratio (MR value) is in the range from 4 to 20, and aging temperature is in the range from 150° to 750° C., preferably, in the range from 200° to 700° C.

As described above, according to the stainless steel wire product of the present invention, there is provided the two-phase stainless steel wire containing the specified composition (wt %) of C, Si, Mn, P, S, Cr, Ni, Mo and N, wherein the ferrite amount (volume ratio) is specified, whereby the fatigue life is greatly prolonged and the corrosion resistance especially the rust resistance is improved. Moreover, in the above two-phase stainless steel wire, by specifying the drawing draft and the mean slenderness ratio ($M_R$ value), the tensile fatigue strength can be extremely enhanced. Additionally, in the above two-phase stainless steel wire, by specifying the added amount of N to be in the range from 0.1 to 0.4 wt % and by controlling the aging temperature to be in the range from 200° to 700° C., it is possible to extremely improve the relaxation (for the tension member) and the creep characteristic (for the wire rope). As a consequence, the wire product made of the two-phase stainless steel is expected to be widely used for the applications in which both the stainless steel and the high carbon steel have been conventionally used.

DETAILED DESCRIPTION OF THE INVENTION

Figure 1:
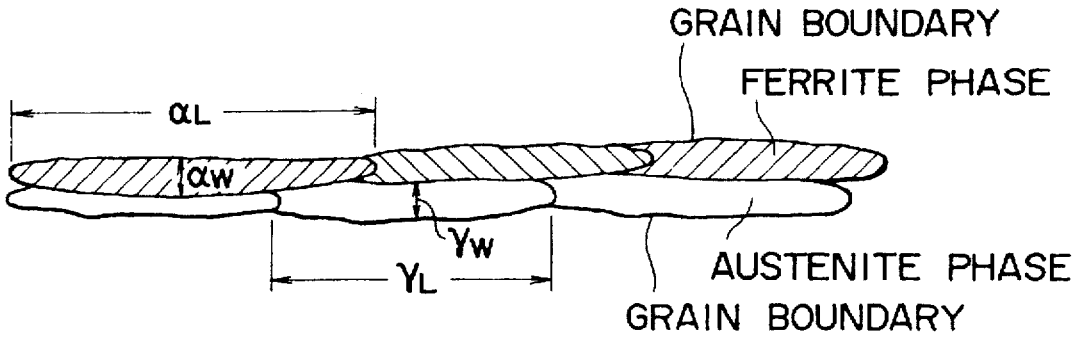
FIG. 1 is an enlarged illustration showing the structure of a two-phase stainless steel wire.
Figure 2:
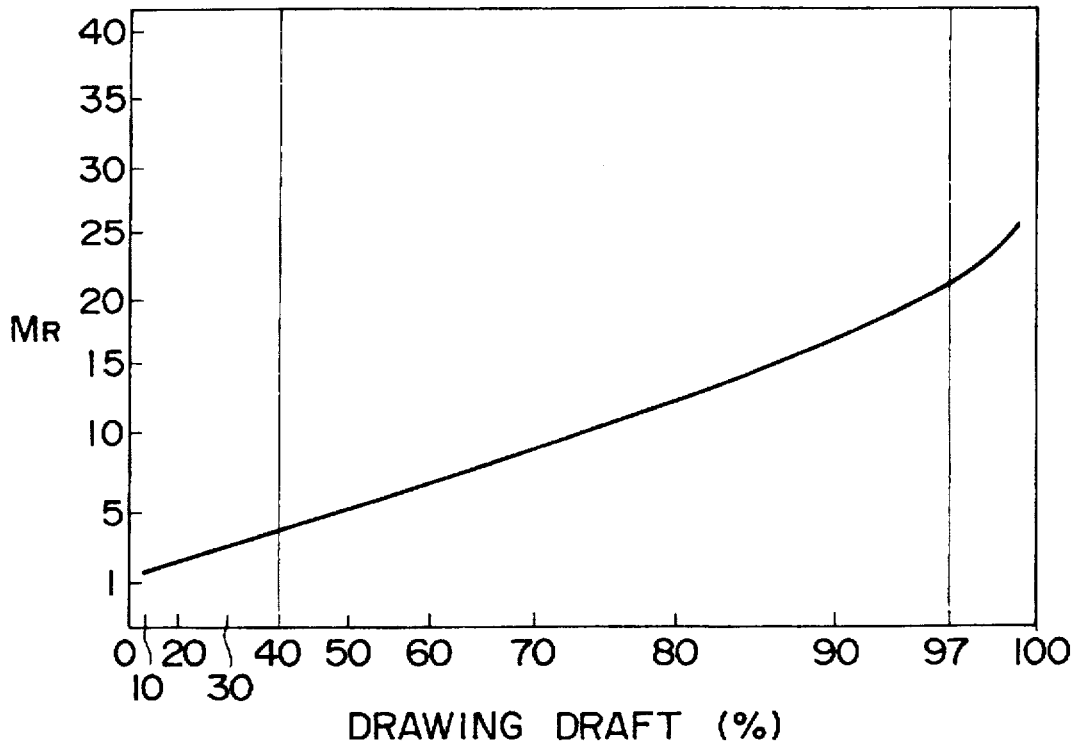
FIG. 2 is a diagram showing the relationship between the drawing draft (%) and the mean slenderness ratio $M_R$ of a two-phase stainless steel wire.
Figure 3:
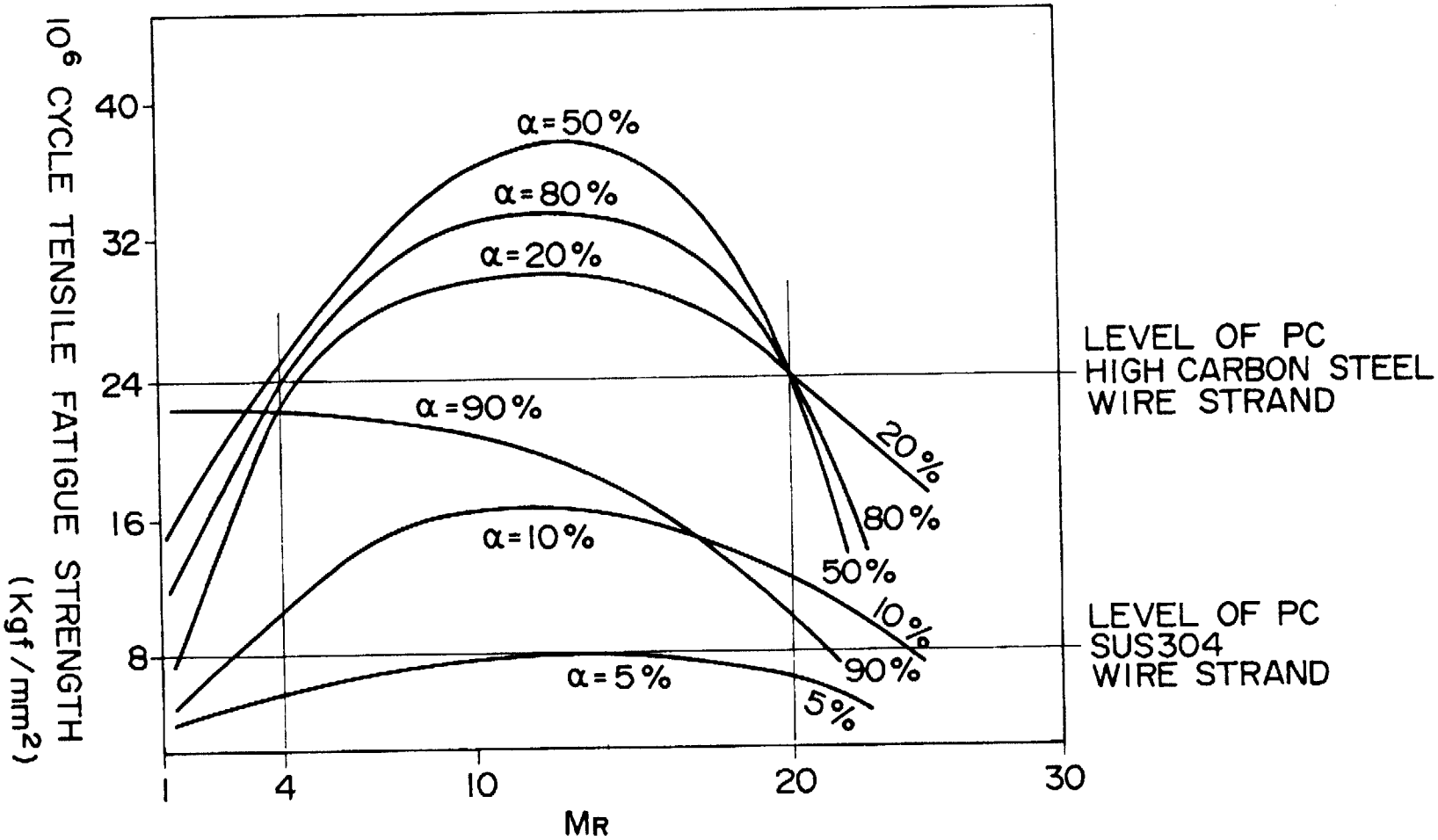
FIG. 3 is a diagram showing the relationship between the mean slenderness ratio $M_R$ and the tensile fatigue strength with respect to the volume ratio of ferrite in two-phase stainless steel wire strands.
Figure 4:
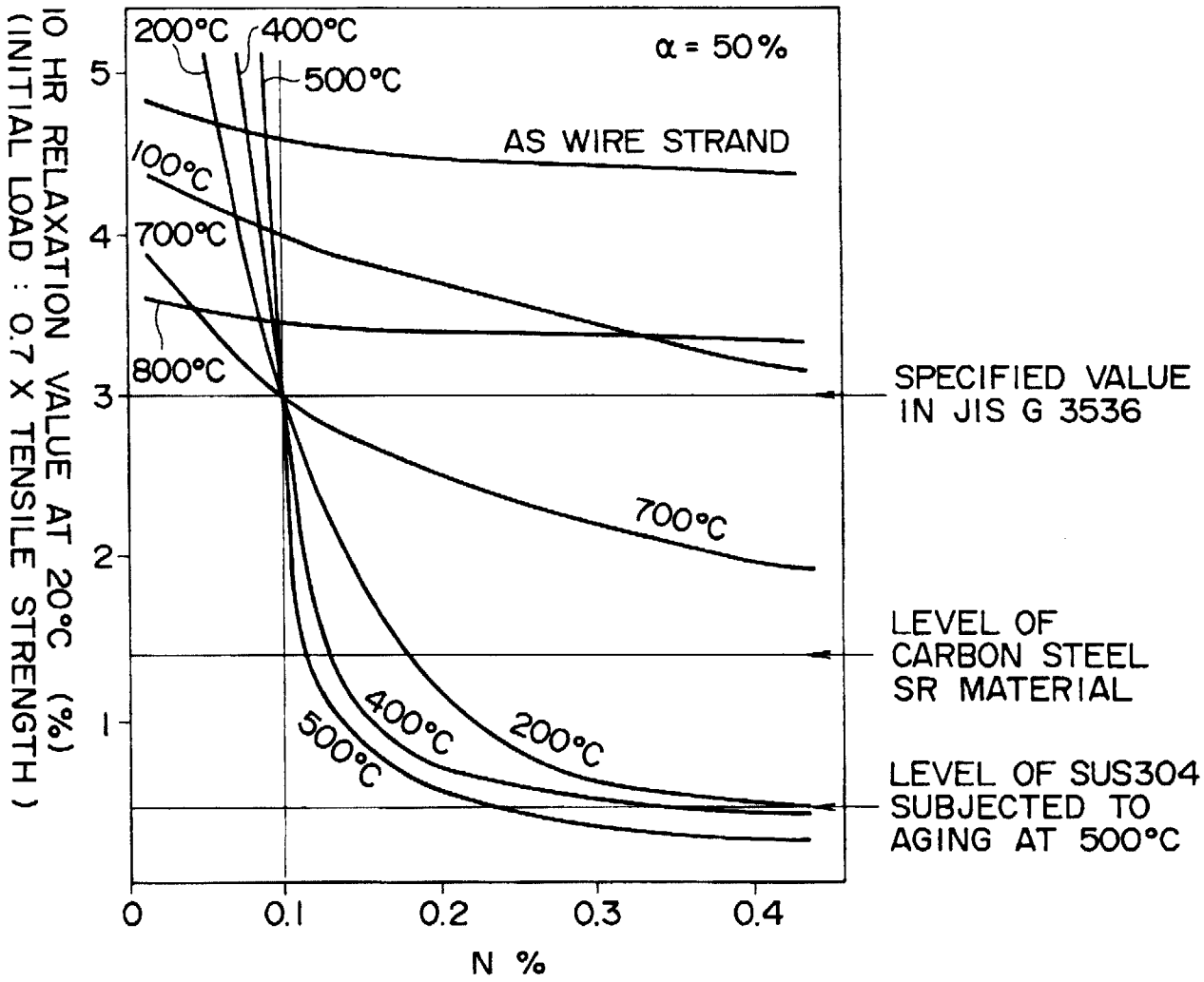
FIG. 4 is a diagram showing the relationship between the change of the N content and the change of the relaxation value depending on the aging temperature in two-phase stainless steel wires containing the ferrite amount of 50% in volume.
Figure 5:
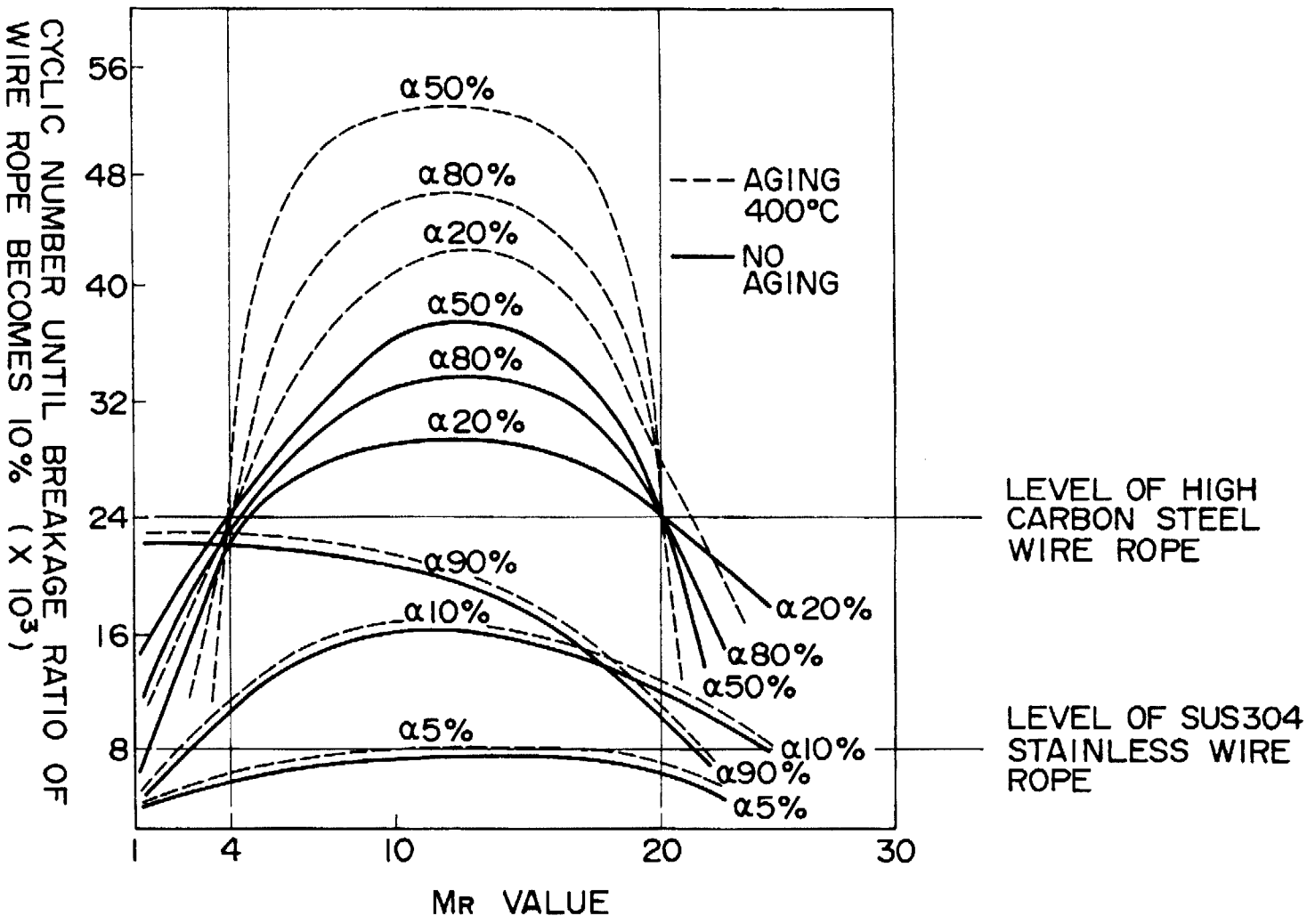
FIG. 5 is a diagram showing the relationship between the mean slenderness ratio $M_R$ and the cyclic bending fatigue limit in two-phase stainless steel wire ropes.
Figure 6:
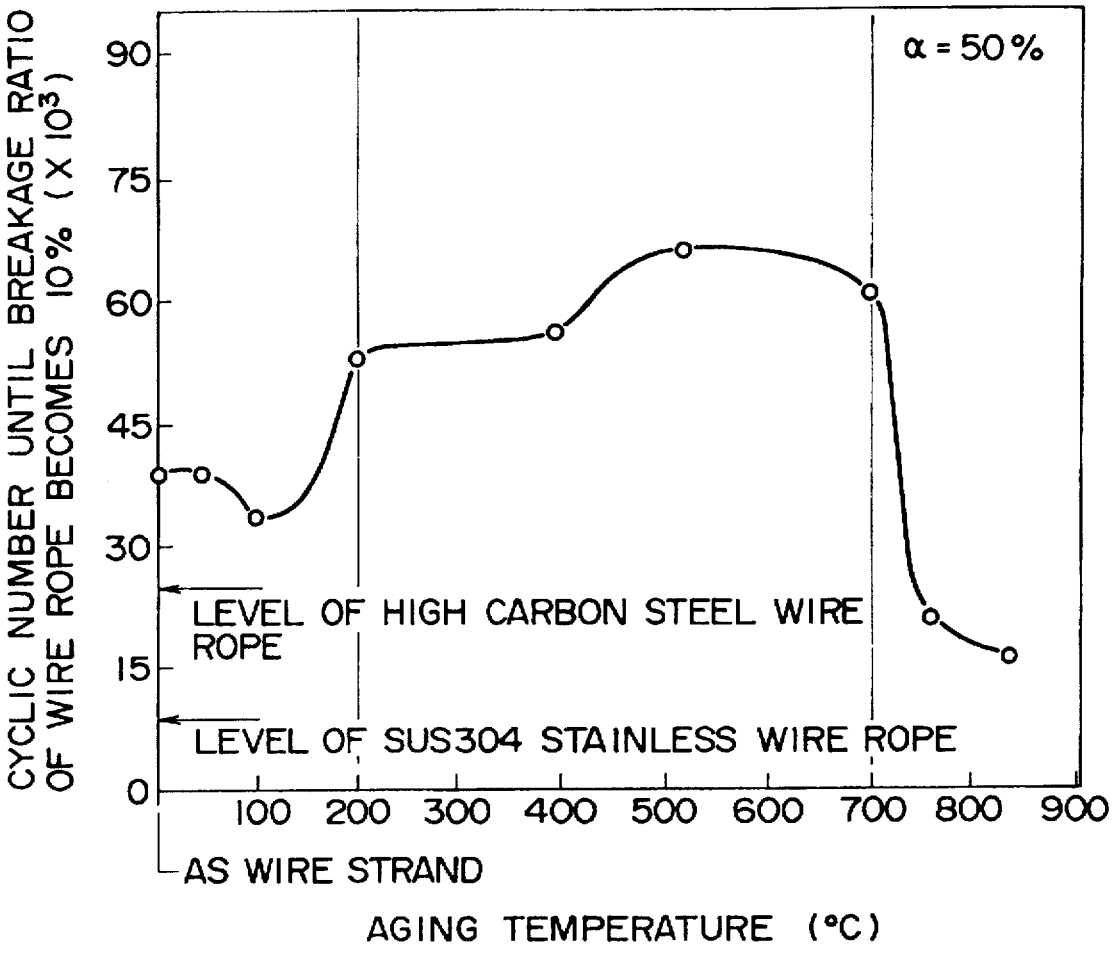
FIG. 6 is a diagram showing the relationship between the aging temperature and the cyclic bending fatigue limit in a two-phase stainless steel wire rope.
Figure 7:
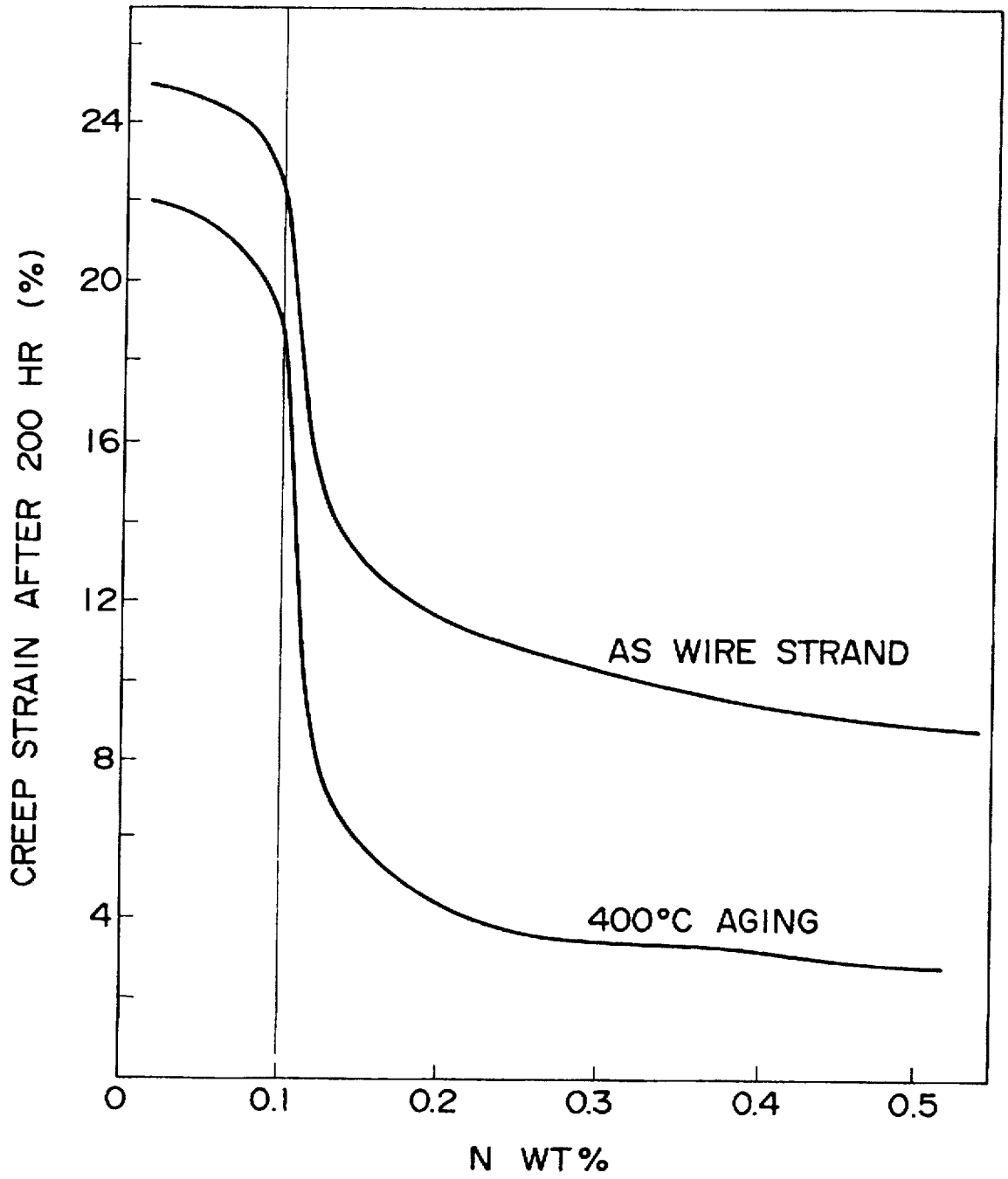
FIG. 7 is a diagram showing the relationship between the N content (wt %) and the creep strain after 200 hr in two-phase stainless steel wire rope.

Hereinafter, embodiments of the present invention will be described. To examine the effect of the characteristics of a two-phase stainless steel wire suitable for a stainless steel wire tension member according to the present invention, it was compared with comparative steel wires. For comparing the effects of α (ferrite volume ratio), N, $M_R$ value and aging temperature, in the embodiments, the steels having the compositions shown in Table 1 were used. The compositions of a high carbon steel wire, and austenite stainless steel wires (SUS304, SUS316) as comparative steel wires were shown similarly in Table 1. In addition, Steel A contains Ni in an amount exceeding the specified value of the present invention, and Steel C contains Ni in an amount less than the specified valve. Steel D is used as the comparative steel in which N is out of the lower limit of the specified value.

Embodiment 1

This embodiment was carried out to examine the effect of α using Steels A, B and C.

Embodiment 1-a

PC steel wires of 5 mm ϕ using Steels A, B and C and comparative steels were manufactured as follows. Rolled wires of 13 mm ϕ using Steels A, B and C were subjected to water toughening at 1050° C., to be thus homogenized, and subsequently subjected to acid picking and to oxalic acid coating. The resultant wires were drawn by a continuous drawing machine in an eight-stage manner with a drawing speed of 100 m/min to be wires of 5 mm ϕ. These wires were straightened by a rotary barrel type straightener, and then subjected to aging treatment at 500° C. using a tunnel furnace, to be finished in PC steel wires. On the other hand, stainless steel wires (SUS303 and SUS316) of 10 mmϕ were subjected to water toughening at 1150° C., to be thus homogenized, and then subjected to the same surface treatment as described above and drawn under the same condition as described above, to be wires of 5 mm ϕ. These wires were straightened in the same manner as described above, and then subjected to aging treatment at 500° C., thus manufacturing PC stainless steel wires. Moreover, high carbon steel wires of 11 mmϕ were subjected to lead parenting at 550° C., and then subjected to HCl picking and to phosphate coating. The resultant wires were drawn by a continuous drawing machine in an eight-stage manner with a drawing speed of 150 m/min to be wires of 5 mm ϕ. After being straightened, these wires were subjected to aging treatment at 380° C., to be finished in PC high carbon steel wires.

The characteristics of the above steel wires are shown in Table 2. The relaxation value is obtained under the condition that the initial load being 0.7 times the tensile strength is applied for 10 hr at 20° C. The tensile fatigue strength is obtained under the condition that the cyclic stress is changed while the maximum load is specified to be 0.45 time the tensile strength. The cyclic rate is 60 cycle/min, and $2\times10^6$ cycle is taken as limit cycle for the fatigue test. The rust resistance is expressed as a time elapsed until the generation of rust in 3% NaCl solution spray.

As is apparent from Table 2, in Steel A containing a smaller amount of α% (12%), the elongation is less than the specification (4% or more), and the torsion value and the fatigue strength are very low. In Steel C containing a larger amount of α% (88%), the elongation is high but the torsion value and the fatigue strength are low, rust is relatively early generated, and the relaxation is poor. On the contrary, in Steel B containing a α% (51%, α and γ are substantially equally mixed) as Inventive Example, the strength, elongation, reduction of area and torsion value are high, especially the fatigue strength is very high, and further, the corrosion resistance is extremely excellent.

Embodiment 1-b

PC steel wire strands of 12.4 mm ϕ using Steels A, B, C and comparative steels were manufactured as follows. Rolled wires of 11 mm ϕ using Steels A, B and C were subjected to water toughening at 1050° C., and then subjected to acid picking and to oxalic acid coating. The resultant wires were drawn by a continuous drawing machine to be side wires of 4.09 mm ϕ and core wires of 4.30 mm ϕ. These wires were stranded into wire strands (construction: 1×7) of 12.4 mm ϕ by a strander, and then finished by aging treatment at 500° C. On the other hand, rolled wires of 9.0 mmϕ of stainless steels (SUS303 and SUS316) were subjected to water toughening at 1150° C. These wire were stranded into wire strands of 12.4 mm ϕ in the same manner as described above, and then finished by aging treatment at 500° C. Moreover, rolled wires of 10 mmϕ of high carbon steels were subjected to lead parenting at 550° C., and then subjected to HCl pickling and to phosphate coating. The resultant wires were drawn by a continuous drawing machine to be side wires of 4.09 mm ϕ and core wires of 4.30 mm ϕ. These wires were stranded into wire strands (construction: 1×7), and finished by aging treatment at 380° C.

To examine the characteristics, the above steel wires were subjected to a tensile test, a relaxation test which was made by applying an initial load being 0.7 times the tensile strength for ten hours at 20° C., a fatigue strength test ($2\times10^6$ cycle) made under the maximum load being 0.45×tensile strength, and a rust resistance test in 3% NaCl spray. The results are shown in Table 3.

As shown in Table 3, even in the case of the PC steel wire strands, for Steel A containing a small amount of α% (12%), the elongation and the fatigue strength are low; and for Steel C containing a large amount of α% (88%), the relaxation characteristic is poor, the fatigue strength is low, and the corrosion resistance is poor. On the contrary, in Steel B where α and γ are equally mixed, the elongation is large, especially the fatigue strength and the corrosion resistance are significantly higher than those of the high carbon steels and stainless steels (SUS304 and SUS316).

Embodiment 2

For steel wires in which the ferrite volume ratio α is specified at 50%, the effects of the $M_R$ value, N wt % and aging temperature will be described below. Steel B, and Steel D (N: 0.05 wt %) were used. The PC steel wire strand using Steel D having the same diameter was manufactured in the same procedure as for Steel B. The PC steel wire strands using Steel B with different $M_R$ values were manufactured as follows. The PC steel wire strand using Steel B with $M_R$ value of 3 was manufactured as follows. Rolled wires (intermediate diameter: 5.1 mmϕ) using Steel B were subjected to water toughening (bright annealing in inert gas) at 1050° C., and then subjected to oxalic acid coating. The resultant wires were drawn by a continuous drawing machine to be side wires of 4.09 mm ϕ and core wires of 4.30 mmϕ. These wires were stranded, and then subjected to aging treatment at 500° C. On the other hand, the PC steel wire strand using Steel B with $M_R$ value of 14 was manufactured in the same manner as for Steel B shown in Table 3; and further, it was manufactured in the manner that the aging temperature is changed into 100° C. or 80° C. for examining the effect of the aging temperature. In addition, the characteristics were measured in the same manner as described above. The results are shown in Table 4.

As is apparent from Table 4, when the $M_R$ value is low, the fatigue characteristic is poor, and the relaxation is large when the drawing draft is low. Even when N is high, the relaxation value is large by lowering of the aging temperature (100° C.). When the aging temperature is excessively high (800° C.), the relaxation value is insufficient for the tension member. Moreover, when the N content is low, the relaxation value becomes very large. Namely, it is difficult to obtain the product satisfying all of the characteristics as shown in the embodiment of the present invention in Table 4.

To make clear the effects of the two-phase stainless steel wire product suitable for stainless steel wire ropes according to the present invention, they were compared with comparative ropes.

The steel wires having compositions shown in Table 1 were used, wherein α% and N wt % were changed. High carbon steel wires and stainless steel (SUS304, SUS316) wires were used as comparative wires. These two-phase stainless steel wires were rolled into a diameter of 5.5 mmϕ, and were finished into a final diameter of 0.33 mmϕ by repeating the drawing and the intermediate annealing. The resultant steel wires were stranded into a wire rope (construction: 1×7) of 5 mmϕ. In this case, the intermediate annealing and the annealing after final drawing were made at 1050° C. Moreover, the drawing draft was changed into 30%, 85% and 98% for each kind of steel, to thus change the $M_R$ value into 3, 14 and 22. Accordingly, the intermediate wire diameters before the final drawing are different for each drawing draft. The drawing was made by passing through dies 3 to 20 times according to the drawing draft at a drawing speed of 100 to 350 m/min using a cone type stepped-wheel drawing machine. To examine the effect of the aging temperature, the two-phase stainless steel wire ropes of 5 mmϕ were subjected to aging treatment for 15 min at 100° C., 400° C. and 800° C.

The stainless steel (SUS304, SUS316) wires of a 5.5 mmϕ were repeatedly subjected to intermediate drawing and annealing, and stranded into a wire rope (construction: 1×7) of 5 mmϕ. In this case, the annealing temperature was 1150° C. On the other hand, the high carbon steel wires were subjected to intermediate drawing, and then subjected to salt parenting at 550° C., after which they were drawn into a final diameter of 0.33 mmϕ in the same manner as described above. The resultant wires were stranded into a wire rope (construction: 7×19) of 5 mmϕ. These wire ropes were examined for the following characteristics.

The tensile strength was measured using a sample with both ends fixed with a sleeve filled with a hardened resin. The cyclic bending fatigue test was made under the condition that the axial load was set to be 20% of the breakage load of the rope and the sheave groove diameter D and the rope diameter d is specified to be D/d=40. In this test, the life of the rope was defined as the cyclic number at which 10% of the total number of the wires of the rope was broken in consideration of the relation between the number of cycles and the number of broken ropes.

The creep test was made by applying the load being 30% of the rope breakage load to the rope and measuring the elongation after 200 hr, thereby obtaining the elongation ratio (%) with respect to the gauge length of 300 mm. The test was made at room temperature. The salt water spray test was made by spraying 3% NaCl solution at 30° C., and measuring the time elapsed until the generation of rust.

The results are shown in Tables 5 and 6. From these tables, the following becomes apparent.

1) From the comparison among Steels A, B and C, when a is small (12%) or large (88%), even when changing the mean slenderness ratio $M_R$ by the drawing draft or changing the aging temperature, the 10% breakage cyclic number for each of the ropes of Steels A, B and C does not exceed that of the high carbon steel wire rope which is regarded as excellent in fatigue. On the contrary, in the case of Steel B where α is 51%, even when $M_R$ is small (3) or large (22), it is superior in fatigue to the high carbon steel wire; particularly, when being subjected to aging treatment at 400° C., it is extremely enhanced to be about twice that of the high carbon steel wire.

2) In the case of Steels A, B and C containing N in amounts from 0.24 to 0.26 wt %, when the drawing draft is small (30%), the creep characteristic at room temperature is inferior to Steel D containing N in a small amount of 0.05 wt %. However, when the drawing draft is larger, the creep is made small irrespective of α, and therefore, it is apparent that the creep is greatly affected by the N content.

3) As for the time elapsed until generation of rust, Steel B is extremely excellent.

As described above, in Steel B, the composition satisfies the specification of the present invention; α is 51% which is within the specified range; and $M_R$ is suitable value, that is, 14. Accordingly, the two-phase stainlessthe steel wire rope using Steel B, as stranded or with aging treatment up to 700° C., is very superior in the fatigue, creep and rust resistance to the high carbon steel wire rope and the stainless steel (SUS304, SUS316) wire rope.

TABLE 1

| | C | Si | Mn | P | S | Ni | Cr | Mo | N | Ferrite α (%) | Remarks |
|---|---|---|---|---|---|---|---|---|---|---|---|
| Steel A | 0.05 | 0.40 | 1.00 | 0.015 | 0.005 | 8.80 | 28.00 | 2.10 | 0.250 | 12 | Comparative example |
| Steel B | 0.04 | 0.41 | 1.05 | 0.020 | 0.004 | 6.10 | 23.88 | 1.70 | 0.260 | 51 | Inventive example |
| Steel C | 0.05 | 0.48 | 1.07 | 0.021 | 0.006 | 2.48 | 27.98 | 0.87 | 0.240 | 88 | Comparative example |
| Steel D | 0.04 | 0.38 | 1.06 | 0.020 | 0.007 | 6.91 | 15.78 | 1.66 | 0.050 | 50 | Comparative example |
| High carbon steel wire | 0.82 | 0.30 | 0.61 | 0.020 | 0.030 | — | — | — | 0.006 | — | Comparative example |
| SUS304 stainless steel wire | 0.06 | 0.45 | 1.29 | 0.030 | 0.008 | 9.10 | 18.11 | — | 0.010 | 0 | Comparative example |
| SUS304 stainless steel wire | 0.06 | 0.66 | 1.14 | 0.028 | 0.005 | 13.00 | 17.88 | 2.36 | 0.012 | 0 | Comparative example |

TABLE 2

| Kind of steel | Wire diameter (mm) | Draft (%) | $M_R$ value | Ferrite (%) | Tensile strength (Kgf/mm²) | Elongation (%) GL = 100 mm | Reduction of area (%) | Torsion value (number) GL = 1000/60 rpm | Relaxation value (%) 10 hr | Tensile fatigue strength (Kgf/mm²) | Time elapsed until generation of rust in salt spray test (hr) | Remarks |
|---|---|---|---|---|---|---|---|---|---|---|---|---|
| A | 5.01 | 85.2 | 14.0 | 12 | 189 | 2.5 | 35 | 3 | 0.90 | 14 | 240 | Comparative example |
| B | 5.00 | 85.2 | 14.0 | 51 | 182 | 6.8 | 58 | 38 | 0.42 | 40 | 700 | Inventive example |
| C | 5.00 | 85.2 | 14.0 | 88 | 150 | 6.0 | 53 | 8 | 3.21 | 19 | 100 | Comparative example |
| High carbon | 5.00 | 79.3 | — | — | 185 | 5.5 | 45 | 24 | 1.10 | 28 | 7 | Comparative example |

TABLE 2-continued

| Kind of steel | Wire diameter (mm) | Draft (%) | $M_R$ value | Ferrite (%) | Tensile strength (Kgf/mm$^2$) | Elongation (%) GL = 100 mm | Reduction of area (%) | Torsion value (number) GL = 1000/60 rpm | Relaxation value (%) 10 hr | Tensile fatigue strength (Kgf/mm$^2$) | Time elapsed until generation of rust in salt spray test (hr) | Remarks |
|---|---|---|---|---|---|---|---|---|---|---|---|---|
| steel | | | | | | | | | | | | |
| SUS304 | 4.99 | 75.0 | — | 0 | 178 | 2.0 | 42 | 3 | 0.68 | 7 | 185 | Comparative example |
| SUS316 | 4.99 | 75.0 | — | 0 | 170 | 2.8 | 48 | 4 | 0.80 | 6 | 220 | Comparative example |

TABLE 3

| Kind of steel | Size (mm) | Ferrite (%) | Tensile strength (Kgf/mm$^2$) | Elongation (%) GL = 600 mm | Relaxation value (%) 10 hr | Tensile fatigue strength (Kgf/mm$^2$) | Time elapsed until generation of rust in salt spray test (hr) | Remarks |
|---|---|---|---|---|---|---|---|---|
| A | 12.4 | 12 | 187 | 2.8 | 1.00 | 12.0 | 200 | Comparative example |
| B | 12.4 | 51 | 180 | 6.5 | 0.51 | 38.0 | 680 | Inventive example |
| C | 12.4 | 88 | 148 | 6.0 | 3.48 | 17.0 | 90 | Comparative example |
| High carbon steel | 12.4 | — | 182 | 5.5 | 1.25 | 24.0 | 5 | Comparative example |
| SUS304 | 12.4 | 0 | 176 | 2.3 | 0.70 | 8.0 | 170 | Comparative example |
| SUS316 | 12.4 | 0 | 171 | 2.5 | 0.80 | 7.5 | 200 | Comparative example |

TABLE 4

| Kind of steel | Size (mm) | Ferrite (%) | $M_R$ value | Aging temperature (°C.) | Tensile strength (Kgf/mm$^2$) | Elongation (%) GL = 600 mm | N (%) | Relaxation value (%) 10 hr | Tensile fatigue strength (Kgf/mm$^2$) | Remarks |
|---|---|---|---|---|---|---|---|---|---|---|
| Steel B | 12.4 | 51 | 3.0 | 500 | 110 | 10.5 | 0.26 | 7.4 | 14.0 | Comparative example |
| | 12.4 | 51 | 14.0 | 100 | 171 | 6.8 | 0.26 | 3.6 | 30.0 | Comparative example |
| | 12.4 | 51 | 14.0 | 500 | 182 | 6.5 | 0.26 | 0.51 | 38.0 | Inventive example |
| | 12.4 | 51 | 14.0 | 800 | 156 | 7.5 | 0.26 | 3.4 | 31.0 | Comparative example |
| Steel D | 12.4 | 50 | 14.0 | 500 | 160 | 6.0 | 0.05 | 7.0 | 30.5 | Comparative example |

TABLE 5

| Item Kind of steel | Ferrite volume ratio α (%) | Drawing draft (%) | $M_R$ value | Aging temperature (°C.) | Tensile strength (Kgf/mm$^2$) | Number of cycles until breakage ratio of wire becomes 10% (number) × $10^3$ | Creep amount after 200 hr at room temperature (%) | Time elapsed until generation of rust (hr) | Remarks |
|---|---|---|---|---|---|---|---|---|---|
| Rope A | 12 | 30 | 3 | as wire strand | 118 | 11 | — | 218 | Comparative example |
| | | | | 100 | 118 | 10 | — | — | Comparative example |
| | | | | 400 | 120 | 12 | — | 210 | Comparative example |

TABLE 5-continued

| Item Kind of steel | Ferrite volume ratio α (%) | Drawing draft (%) | $M_R$ value | Aging temperature (°C.) | Tensile strength (Kgf/mm²) | Number of cycles until breakage ratio of wire becomes 10% (number) × 10³ | Creep amount after 200 hr at room temperature (%) | Time elapsed until generation of rust (hr) | Remarks |
|---|---|---|---|---|---|---|---|---|---|
| | | | | 800 | 109 | 8 | — | — | Comparative example |
| | | 85 | 14 | as wire strand | 198 | 16 | 10 | 220 | Comparative example |
| | | | | 100 | 199 | 14 | 10 | — | Comparative example |
| | | | | 400 | 205 | 17 | 6 | 220 | Comparative example |
| | | | | 800 | 178 | 14 | 8 | — | Comparative example |
| | | 98 | 22 | as wire strand | 218 | 12 | — | 224 | Comparative example |
| | | | | 100 | 220 | 11 | — | — | Comparative example |
| | | | | 400 | 228 | 12 | — | 225 | Comparative example |
| | | | | 800 | 190 | 11 | — | — | Comparative example |
| Rope B | 51 | 30 | 3 | as wire strand | 111 | 17 | 29 | 710 | Comparative example |
| | | | | 100 | 114 | 16 | 28 | — | Comparative example |
| | | | | 400 | 118 | 18 | 24 | 715 | Comparative example |
| | | | | 800 | 106 | 16 | 28 | — | Comparative example |
| | | 85 | 14 | as wire strand | 180 | 36 | 11 | 705 | Inventive example |
| | | | | 100 | 182 | 32 | 10 | — | Inventive example |
| | | | | 400 | 191 | 54 | 3 | 718 | Inventive example |
| | | | | 800 | 167 | 17 | 12 | — | Comparative example |
| | | 98 | 22 | as wire strand | 207 | 14 | 10 | 712 | Comparative example |
| | | | | 100 | 210 | 12 | 10 | — | Comparative example |
| | | | | 400 | 218 | 9 | 3 | 710 | Comparative example |
| | | | | 800 | 181 | 4 | 10 | — | Comparative example |

TABLE 6

| Item Kind of steel | Ferrite volume ratio α (%) | Drawing draft (%) | $M_R$ value | Aging temperature (°C.) | Tensile strength (Kgf/mm²) | Number of cycles until breakage ratio of wire becomes 10% (number) × 10³ | Creep amount after 200 hr at room temperature (%) | Time elapsed until generation of rust (hr) | Remarks |
|---|---|---|---|---|---|---|---|---|---|
| Rope C | 88 | 30 | 3 | as wire strand | 102 | 20 | — | 105 | Comparative example |
| | | | | 100 | 102 | 18 | — | — | Comparative example |
| | | | | 400 | 108 | 20 | — | 110 | Comparative example |
| | | | | 800 | 100 | 14 | — | — | Comparative example |
| | | 85 | 14 | as wire strand | 131 | 17 | 14 | 95 | Comparative example |
| | | | | 100 | 134 | 16 | 12 | — | Comparative example |
| | | | | 400 | 139 | 18 | 9 | 100 | Comparative example |
| | | | | 800 | 114 | 13 | 11 | — | Comparative example |
| | | 98 | 22 | as wire strand | 169 | 8 | — | 105 | Comparative example |
| | | | | 100 | 171 | 8 | — | — | Comparative example |
| | | | | 400 | 177 | 8 | — | 115 | Comparative example |
| | | | | 800 | 103 | 4 | — | — | Comparative example |
| Rope D | 50 | 80 | 14 | as wire strand | 158 | — | 25 | — | Comparative example |
| | | | | 400 | 166 | — | 21 | — | Comparative example |
| Carbon steel | — | 89 | — | as wire strand | 208 | 24 | 18 | 6 | Comparative example |
| SUS304 | 0 | 90 | — | as wire strand | 201 | 8 | 28 | 170 | Comparative example |
| SUS316 | 0 | 90 | — | as wire strand | 182 | 7 | 24 | 205 | Comparative example |

What is claimed is:

1. A stainless steel product, consisting essentially of:

0.01–0.10 wt % of C, 0.1–1.0 wt % of Si, 0.30–1.50 wt % of Mn, 0.010–0.040 wt % of P, 0.001–0.030 wt % of S, 18.0–30.0 wt % of Cr, 3.0–8.0 wt % of Ni, 0.1–3.0 wt % of Mo, 0.10–0.45 wt % of N, and the balance being Fe and inevitable impurities, wherein said stainless steel product comprises a first phase and a second phase, said first phase is ferrite and said second phase is austenite, and a volume ratio of said ferrite, to said austenite and said ferrite, is 35 to 65%, said stainless steel member is a wire, grains of said first and second phases are extended along the length of said wire, and said stainless steel member has a mean slenderness ratio of 12–14.

2. The stainless steel product of claim 1, wherein said product has been subject to aging at a temperature of 200°–700° C.

3. The stainless steel product of claim 1, wherein said wire has a diameter of 5–0.33 mm.

4. A stranded member, comprising a plurality of the stainless steel products of claim 1.

5. The stainless steel product of claim 1, wherein the number of cycles until a breakage ratio of the wire rope becomes 10% is at least $32\times10^3$.

6. The stainless steel product of claim 7, wherein the number of cycles until a breakage ratio of the wire rope becomes 10% is at least $36\times10^3$.

7. The stainless steel product of claim 1, wherein said wire has a tensile fatigue strength of at least 24 Kgf/mm$^2$.

8. A stainless steel product, consisting essentially of:

0.01–0.10 wt % of C, 0.1–1.0 wt % of Si, 0.30–1.50 wt % of Mn, 0.010–0.040 wt % of P, 0.001–0.030 wt % of S, 18.0–30.0 wt % of Cr, 3.0–8.0 wt % of Ni, 0.1–3.0 wt % of Mo, 0.10–0.4 wt % of N, and the balance being Fe and inevitable impurities, wherein said stainless steel product comprises a first phase and a second phase, said first phase is ferrite and said second phase is austenite, and a volume ratio of said ferrite, to said austenite and said ferrite, is 35 to 65%, said stainless steel product is a wire, grains of said first and said second phases are extended along the length of said wire, and said stainless steel product has a mean slenderness ratio of 12–14.

9. The stainless steel product of claim 8, wherein said product has been subject to aging at a temperature of 200°–700° C.

10. The stainless steel product of claim 8, wherein said product has been subject to aging at a temperature of 150°–750° C.

11. The stainless steel product of claim 8, wherein said wire has a diameter of 5–0.33 mm.

12. A stranded member, comprising a plurality of the stainless steel products of claim 8.

13. The stainless steel product of claim 8, wherein the number of cycles until a breakage ratio of the wire rope becomes 10% is at least $32\times10^3$.

14. The stainless steel product of claim 8, wherein the number of cycles until a breakage ratio of the wire rope becomes 10% is at least $36\times10^3$.

15. The stainless steel product of claim 8, wherein said wire has a tensile fatigue strength of at least 24 Kgf/mm$^2$.

16. A product produced by a process comprising:

heating a first wire, thereby homogenizing said wire;

drawing said first wire until the cross-sectional area is reduced by 40–97%, thereby forming a second wire;

wherein said second wire consists essentially of:

0.01–0.10 wt % of C, 0.1–1.0 wt % of Si, 0.30–1.50 wt % of Mn, 0.010–0.040 wt % of P, 0.001–0.030 wt % of S, 8.0–30.0 wt % of Cr, 3.0–8.0 wt % of Ni, 0.1–3.0 wt % of Mo, 0.10–0.45 wt % of N, and the balance being Fe and inevitable impurities, said second wire comprises a first phase and a second phase, said first phase is ferrite and said second phase is austenite, a volume ratio of said ferrite, to said austenite and said ferrite, is 35 to 65%, grains of said first and said second phases are extended along the length of said wire, and said wire has a mean slenderness ratio of 12 to 14.

17. The product of claim 16, wherein said process further comprises the step of aging said second wire at a temperature of 150°–750° C.

18. The product of claim 16, wherein said process further comprises aging said second wire at a temperature of 200°–700° C.

* * * * *

UNITED STATES PATENT AND TRADEMARK OFFICE

CERTIFICATE OF CORRECTION

PATENT NO. : 5,716,466

DATED : February 10, 1998

INVENTOR(S) : Yukio Yamaoka, et al.

It is certified that error appears in the above-identified patent and that said Letters Patent is hereby corrected as shown below:

Column 1, line 9, "G 3586" should read --G 3536--.

Column 3, line 29, "ME" should read --$M_R$--.

line 33, after "draft of" please insert --93%--.

line 35, "MR" should read --$M_R$--.

Column 5, line 24, "8.0-8.0 wt" should read --3.0-8.0 wt--.

line 31, "MR" should read --$M_R$--.

Column 8, line 22, "80° C" should be --800° C--.

Column 9, line 33, "a" should read --α--.

Column 10, line 26, "stainlessthe" should read --stainless--.

Column 15, line 17, "0.10-0.4 wt" should read --0.10-0.45 wt--.

Column 16, line 19, "8.0-30.0 wt" should read --18.0-30.0 wt--.

Signed and Sealed this

Eighteenth Day of May, 1999

*Attest:*

Q. TODD DICKINSON

*Attesting Officer*

*Acting Commissioner of Patents and Trademarks*